US009044060B2

(12) United States Patent
Delaney

(10) Patent No.: US 9,044,060 B2
(45) Date of Patent: Jun. 2, 2015

(54) CONVERTIBLE SHOE

(76) Inventor: Sean E. F. Delaney, Duluth, GA (US)

( * ) Notice: Subject to any disclaimer, the term of this patent is extended or adjusted under 35 U.S.C. 154(b) by 509 days.

(21) Appl. No.: 13/593,500

(22) Filed: Aug. 23, 2012

(65) Prior Publication Data

US 2014/0053432 A1 Feb. 27, 2014

(51) Int. Cl.

| | |
|---|---|
| ***A43B 3/24*** | (2006.01) |
| ***A43B 3/10*** | (2006.01) |
| ***A43B 3/12*** | (2006.01) |

(52) U.S. Cl.

CPC ..... *A43B 3/102* (2013.01); *A43B 3/244* (2013.01); *A43B 3/122* (2013.01); *A43B 3/242* (2013.01)

(58) Field of Classification Search

USPC ..... 36/101, 11.5

See application file for complete search history.

(56) References Cited

U.S. PATENT DOCUMENTS

| | | | | |
|---|---|---|---|---|
| 2,183,277 | A * | 12/1939 | Heilhecker | 36/14 |
| 2,507,120 | A * | 5/1950 | Shapiro | 36/11.5 |
| 2,607,133 | A * | 8/1952 | Marlowe | 36/11.5 |
| 3,063,167 | A * | 11/1962 | Scholl | 36/11.5 |
| 5,926,978 | A * | 7/1999 | Smith | 36/101 |
| 6,640,464 | B2 * | 11/2003 | Hsin et al. | 36/11.5 |
| 6,772,539 | B1 * | 8/2004 | Tai | 36/11.5 |
| 7,802,381 | B2 * | 9/2010 | Condie | 36/101 |
| 8,220,184 | B2 * | 7/2012 | Albert | 36/101 |
| 2013/0185958 | A1 * | 7/2013 | McGuire | 36/101 |
| 2014/0230279 | A1 * | 8/2014 | Risner | 36/101 |

* cited by examiner

*Primary Examiner* — Ted Kavanaugh

(57) ABSTRACT

A convertible shoe enables people to easily modify a single shoe to form a total of at least three different shoe types. This reduces the bulkiness/amount of a traveler's luggage and reduces the burden of traveling without limiting a traveler's options of available shoe types. The convertible shoe can include a front removable shoe upper to convert between an open-toe and a closed-toe shoe. The convertible shoe can further include a rear removable shoe upper to convert the shoe between closed-back shoe and a sandal-type shoe. The sandal-type shoe can include a removable strap to convert between a strapped and a strapless sandal-type shoe.

10 Claims, 4 Drawing Sheets

CONVERTIBLE SHOE

BACKGROUND OF THE INVENTION

The present invention relates to a convertible shoe and, more particularly, to a shoe that can be converted by the wearer/owner into a total of at least three different shoe types.

When people travel, they often need/desire to have more than one pair/type of shoe. This requires them to pack multiple shoes in their luggage, which increases the amount of luggage they must travel with and thus, increases the difficulty of traveling.

Current shoes do not allow the wearer/owner to easily and predictably convert their individual shoes into several different types of shoes.

As can be seen, there is a need for a convertible shoe that can be easily changed between different types of shoes.

SUMMARY OF THE INVENTION

In one aspect of the present invention, a convertible shoe comprises a sole-base; a front snap plate disposed about a front top edge of the sole-base; a rear snap plate disposed about a rear top edge of the sole-base; a plurality of holes formed through the front and rear snap plates; a non-removable sandal-type shoe upper attached to the sole-base; a front removable shoe upper securable to the non-removable sandal-type shoe upper and to the front snap plate; and a rear removable shoe upper securable to the non-removable sandal-type shoe upper and to the rear snap plate.

In another aspect of the present invention, a convertible shoe comprises a sole-base; a front snap plate disposed in a front snap-fit receptor cavity formed along a front top edge of the sole-base; a rear snap plate disposed in a rear snap-fit receptor cavity formed along a rear top edge of the sole-base; a plurality of holes formed through the front and rear snap plates; a plurality of sole-base holes in the front snap-fit receptor cavity and the rear snap-fit cavity, the plurality of sole-base holes aligning with the plurality of holes formed through the front and rear snap plates when the front and rear snap plates are disposed in the front and rear snap-fit receptor cavities; a non-removable sandal-type shoe upper attached to the sole-base; a front removable shoe upper securable to the non-removable sandal-type shoe upper and to the front snap plate; and a rear removable shoe upper securable to the non-removable sandal-type shoe upper and to the rear snap plate.

These and other features, aspects and advantages of the present invention will become better understood with reference to the following drawings, description and claims.

DETAILED DESCRIPTION OF THE INVENTION

Figure 1:
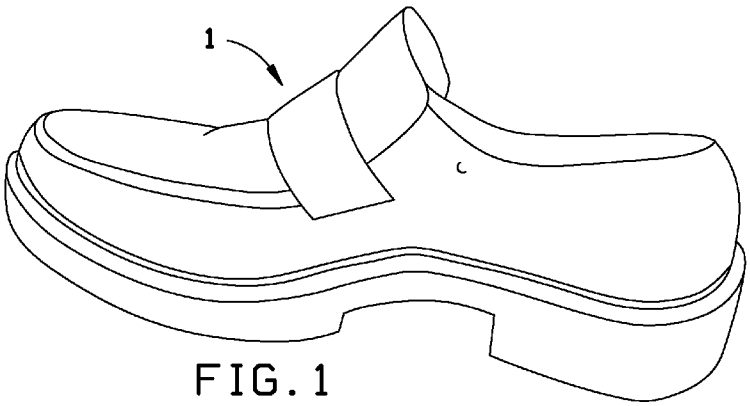
FIG. 1 is a perspective view of a convertible shoe according to an exemplary embodiment of the present invention.
Figure 2:
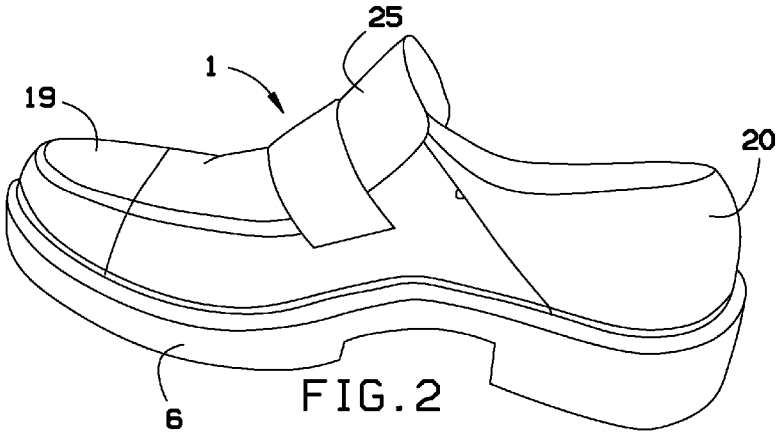
FIG. 2 is a perspective view of the convertible shoe of FIG. 1 showing lines dividing various convertible sections of the shoe.
Figure 3:
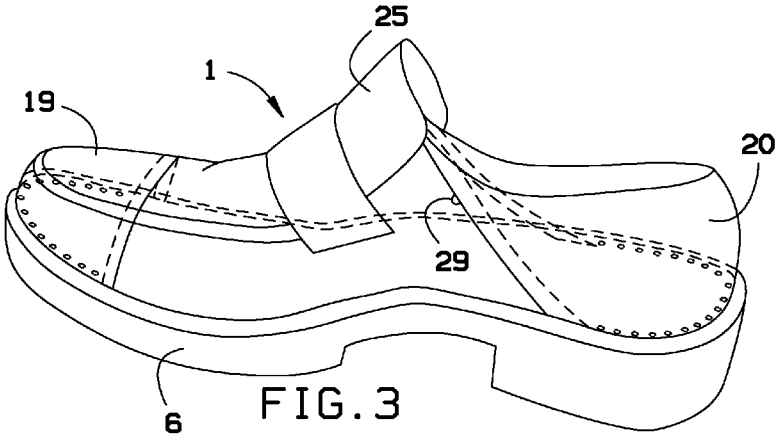
FIG. 3 is a perspective view of the convertible shoe of FIG. 1 showing various attachments for various convertible sections of the shoe.
Figure 4:
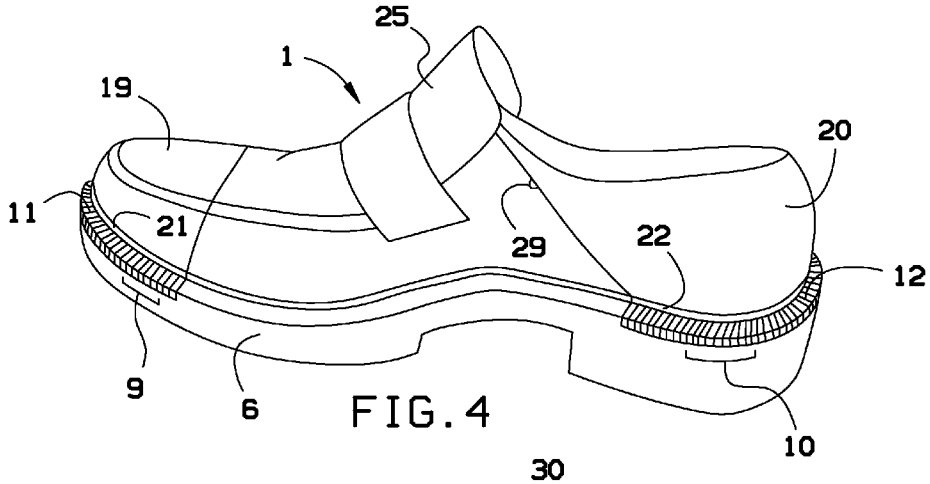
FIG. 4 is a perspective view of the convertible shoe of FIG. 1 showing front and rear snap plates for converting the shoe.
Figure 5:
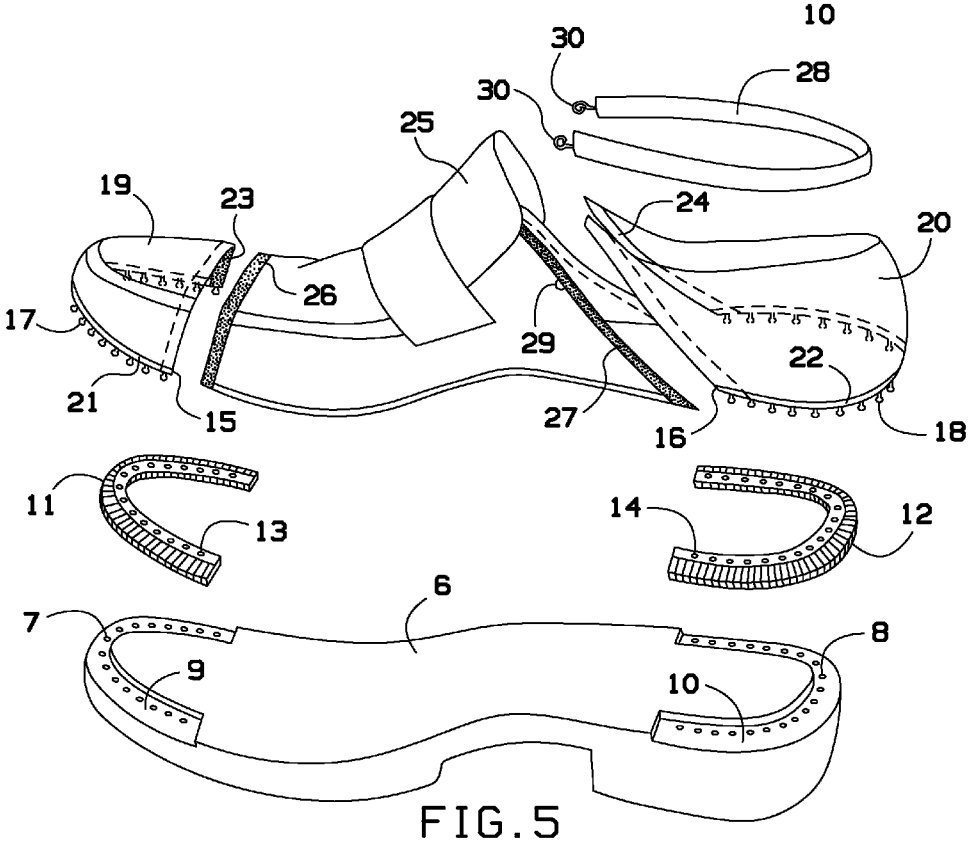
FIG. 5 is an exploded perspective view of the convertible shoe of FIG. 1 and includes a view of the detachable adjustable sandal strap, disposed with the hook attachments of the detachable adjustable sandal strap, which may be used when utilizing the convertible shoe as a closed-toe or open-toe sandal.
Figure 6:
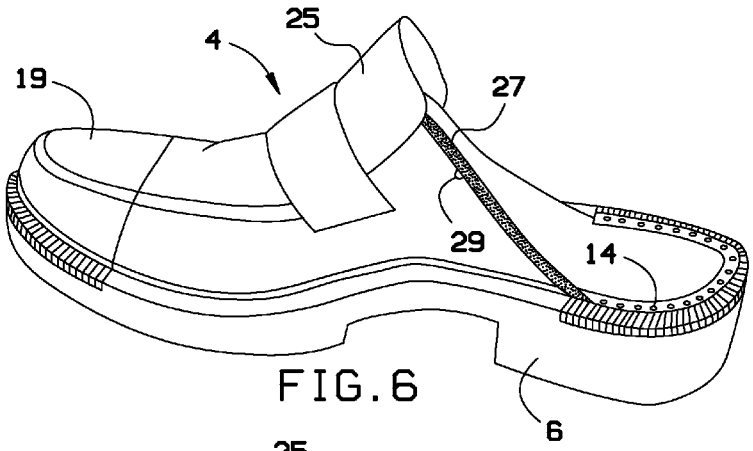
FIG. 6 is a perspective view of a closed-toe sandal-type shoe created from the shoe of FIG. 1.
Figure 7:
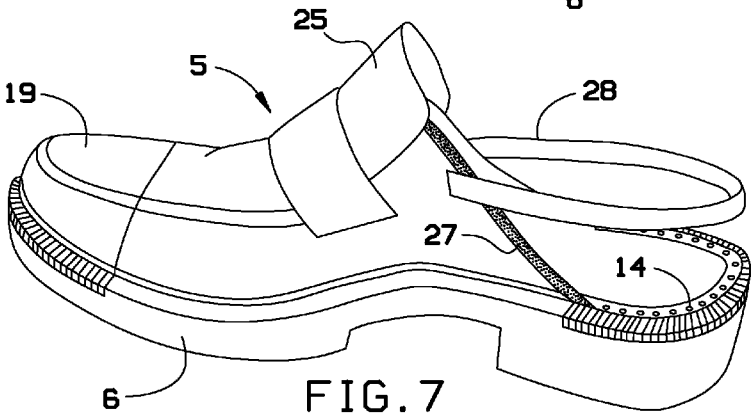
FIG. 7 shows a closed-toe sandal-type shoe with strap created from the shoe of FIG. 1.
Figure 8:
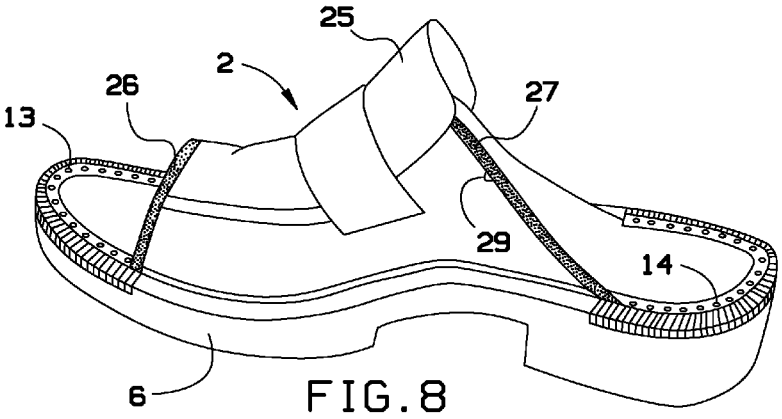
FIG. 8 shows a basic open-toe sandal-type shoe created from the convertible shoe of FIG. 1.
Figure 9:
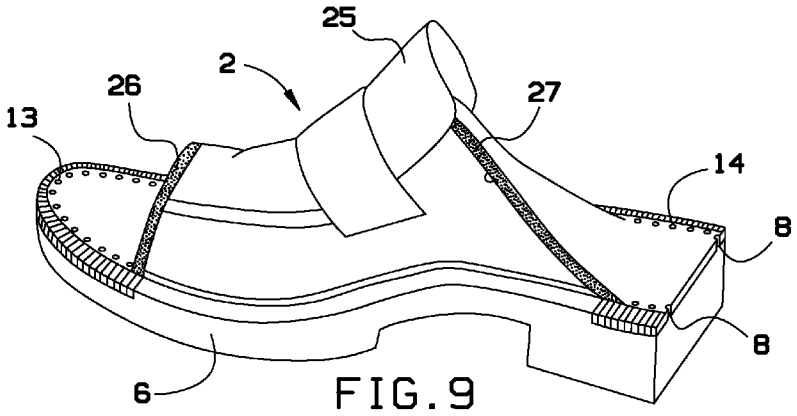
FIG. 9 shows the basic open-toe sandal-type shoe of FIG. 8, cross-sectioned to show a snap-fit receptor cavity on the rear sole-base.
Figure 10:
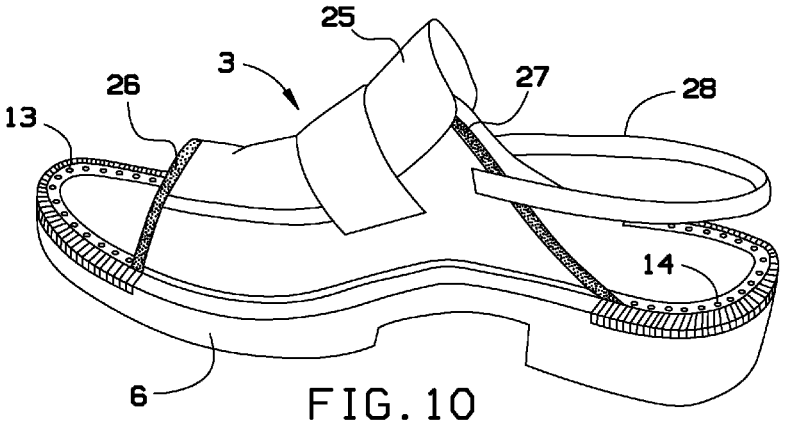
FIG. 10 shows a perspective view of a basic open-toe sandal-type shoe with a strap created from the convertible shoe of FIG. 1.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a convertible shoe that enables people to easily modify a single shoe to form a total of at least three different shoe types. This reduces the bulkiness/amount of a traveler's luggage and reduces the burden of traveling without limiting a traveler's options of available shoe types. The convertible shoe can include a front removable shoe upper to convert between an open-toe and a closed-toe shoe. The convertible shoe can further include a rear removable shoe upper to convert the shoe between closed-back shoe and a sandal-type shoe. The sandal-type shoe can include a removable strap to convert between a strapped and a strapless sandal-type shoe.

Referring now to the Figures, a convertible shoe 1 is a shoe made from a basic open-toe sandal-type shoe 2 to which can be reversibly attached and detached a front removable shoe upper 19 and a rear removable shoe upper 20. The basic open-toe sandal-type shoe 2 can be formed from a sole-base 6 with a permanently attached non-removable sandal-type upper 25 and a permanently attached snap-fit front plate 11 and snap-fit rear plate 12.

The front removable upper 19 can attach to the basic open-toe sandal-type shoe 2 by passing the limbs of a front snap-fit 15 of the front removable upper 19 through holes 13 of the front portion of the snap-plate 11 of the basic open-toe sandal-type shoe 2, such that the barbs/balls 17 of the snap-fit 15 reside in the receptor cavities 7 of a snap-plate nesting place 9 on the sole-base 6 of the basic open-toe sandal-type shoe 2 and by attaching a Velcro-attachment-zone 23 of the front removable upper 19 to the front Velcro-attachment-zone 26 of the non-removable sandal-type upper 25 of the basic open-toe sandal-type shoe 2. While Velcro is described herewithin, any hook and loop type fastener may be used and the position of the hook side and loop side of the fastener may be on either attachment zone 23, 26.

The rear removable upper 20 can attach to the basic open-toe sandal-type shoe 2 by passing the limbs of a rear snap-fit 16 of the rear removable upper 20 through holes 14 of the rear portion of a rear snap-plate 12 of the basic open-toe sandal-type shoe 2, such that the barbs/balls 18 of the rear snap-fit 16 reside in the receptor cavities 8 of a snap-plate nesting place 10 on the sole-base 6 of the basic open-toe sandal-type shoe 2 and by attaching the Velcro-attachment-zone 24 of the rear removable upper 20 to the rear Velcro-attachment-zone 27 of the sandal-type upper 25 of the basic open-toe sandal-type shoe 2.

The sole-base 6 will typically be made of rubber but may be made of any other material suitable as a shoe bottom. The snap-plates 11, 12 can be made of a firm material (e.g., plastic) that has enough rigidity to secure the snap-fits 15, 16 in place yet enough flexibility to allow necessary deformation of the shoe with normal walking. Note that two snap-plate versions are possible. Either the snap-plate forms a continuous layer on top of the sole base 6 or the snap-plate includes two separate snap-plates, front and rear (as shown), that reside on top of the sole base 6 and the corresponding snap-plate nesting places 9, 10.

The uppers 19, 25, 20 can be made of leather or any other material that is typically used for, or that is suitable for, use as a shoe upper.

Figure 11A:
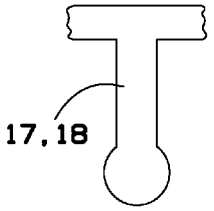
FIG. 11A shows a snap fit ball according to an exemplary embodiment of the present invention.
Figure 11B:
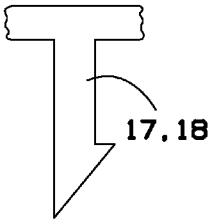
FIG. 11B shows a snap fit barbed leg according to an exemplary embodiment of the present invention.

The snap-fits 15, 16 can be made of a material that is rigid enough (e.g., plastic) to provide the strength necessary for the snap-fits to firmly hold the removable uppers 19, 20 in place when they are attached to the basic open-toe sandal-type shoe 1 and during normal walking. Note that several snap-fit designs 17, 18 are possible based on previously published designs e.g., ball & socket-type (FIG. 11A), barb-type cantilever (FIG. 11B), U & L cantilever type, and the like.

A user may wear the basic open-toe sandal-type shoe 2 with both the front 19 and rear 20 removable uppers attached forming the convertible shoe 1, either only the front removable upper 19 attached forming the closed-toe sandal-type shoe 4, or with neither the front 19 nor rear 20 removable uppers attached forming the basic open-toe sandal-type shoe 2. In addition both the basic open-toe sandal-type shoe 2 and the closed-toe sandal-type shoe 4 may have a detachable adjustable sandal strap 28 attached, via a hook attachment 30 of the detachable adjustable sandal strap 28, to an attachment loop 29 of the non-removable sandal-type upper 25, or detached.

Either removable upper 19 or 20 can be attached to the basic open-toe sandal-type shoe 2 by inserting the limbs 17 and 18 of the snap-fits 15 and 16 respectively through the corresponding holes 13 and 14 in the snap-plates 11 and 12 such that the barbs/balls of the snap-fits 15 and 16 reside securely in the receptor cavities 7 and 8 of the corresponding portions of the sole-base 6 in the region of the snap-plate nesting places 9 and 10, and by attaching the Velcro attachment zones 23 and 24 of the uppers 19 and 20 to the corresponding Velcro attachment zones 26 and 27 on the non-removable sandal-type upper 25.

Similarly, to remove either removable upper 19 or 20 from the basic open-toe sandal-type shoe 2, the user simply pulls upward on the corresponding removable upper 19 or 20 with enough force to dislodge the snap-fits 15 and 16 from their corresponding regions of snap-plates 11 and 12.

Should the user/wearer wish to do so he/she may attach the detachable adjustable sandal strap 28 to either the open-toe sandal-type shoe 2 or the closed-toe sandal type shoe 4 by inserting the hook attachment 30 of the detachable adjustable sandal strap 28, through the attachment loop 29 of the non-removable sandal-type upper 25.

To make the convertible shoe of the present invention, the shoe sole 6 can be created using standard shoe making techniques. The snap plate nesting places 9 and 10 can then be carved out of shoe sole 6. A mold of the snap-plate nesting places 9 and 10 can be made and this can be used to create plastic forms for the snap-fit plates 11 and 12. The snap-fit plates 11 and 12 can be placed into their positions at the respective nesting places 9 and 10 on shoe sole 6 and holes can be drilled through the snap-fit plates 11 and 12 and into the snap-fit plate nesting places 9 and 10, forming the holes 13 and 14 in the respective snap-fit plates as well as forming the snap-fit receptor cavities 7 and 8 in the shoe sole 6. The snap-fit receptor cavities 7 and 8 can then be widened to accommodate the full relaxed size of ball/barb of the snap-fits 17 and 18 such that the balls/barbs are not compressed, thus enabling the snap-fits 15 and 16 to resist dislocation through the holes 13 and 14 of the snap-plates 11 and 12 and thus from shoe sole 6 whenever the snap-fit balls/barbs are inserted into the receptor cavities 7 and 8. The snap-plates 11 and 12 can then be bonded securely into their positions at their respective snap-fit nesting places 9 and 10 on shoe sole 6.

Leather uppers can then be created using standard shoe-making techniques but with a redundancy of material such that there is an overlap of material at the points where the removable upper 19 would join the non-removable upper 25 and where the removable upper 20 would join the non-removable upper 25 at the Velcro-attachment zones 23, 26 and 24, 27 respectively. This redundancy of material can, in fact, be lined with Velcro to form the Velcro attachment zones 23 and 26 as well as 24 and 27.

The snap-fits 15 and 16 can be made by forming plastic ball/barb snap-fits of a predetermined dimension with the neck of the snap-fits attached to a plastic hoop of the same shape as the snap-plates using standard plastic molding techniques. The snap-fits 15 and 16 can be bonded to removable uppers 19 and 20.

It should be understood, of course, that the foregoing relates to exemplary embodiments of the invention and that modifications may be made without departing from the spirit and scope of the invention as set forth in the following claims.

What is claimed is:

1. A convertible shoe comprising:

a sole-base;

a front snap plate disposed about a front top edge of the sole-base;

a rear snap plate disposed about a rear top edge of the sole-base;

a plurality of holes formed through the front and rear snap plates;

a non-removable sandal-type shoe upper attached to the sole-base;

a front removable shoe upper securable to the non-removable sandal-type shoe upper and to the front snap plate; and a rear removable shoe upper securable to the non-removable sandal-type shoe upper and to the rear snap plate.

2. The convertible shoe of claim 1, further comprising:

a front snap-fit receptor cavity on the front top edge of the sole-base, the front snap-fit receptor cavity operable to hold the front snap plate therein; and a rear snap-fit receptor cavity on the rear top edge of the sole-base, the rear snap-fit receptor cavity operable to hold the rear snap plate therein.

3. The convertible shoe of claim 2, further comprising a plurality of sole-base holes in the front snap-fit receptor cavity and the rear snap-fit cavity, the plurality of sole-base holes aligning with the plurality of holes formed through the front and rear snap plates when the front and rear snap plates are disposed in the front and rear snap-fit receptor cavities.

4. The convertible shoe of claim 1, wherein the front and rear removable shoe uppers are securable to the non-removable sandal-type shoe upper with a hook and loop fastener.

5. The convertible shoe of claim 1, wherein the front and rear removable shoe uppers include a snap fit connector adapted to fit into the plurality of holes in the front and rear snap plates.

6. The convertible shoe of claim 5, wherein the snap fit connector is selected from a barbed leg snap fit connector and a ball snap fit connector.

7. The convertible shoe of claim 1, further comprising attachment loops disposed on opposite sides of the non-removable sandal-type shoe upper.

8. The convertible shoe of claim 7, further comprising a detachable adjustable sandal strap operable to connect to the attachment loops and span about a rear of a user's foot when wearing the convertible shoe.

9. A convertible shoe comprising:

a sole-base;

a front snap plate disposed in a front snap-fit receptor cavity formed along a front top edge of the sole-base;

a rear snap plate disposed in a rear snap-fit receptor cavity formed along a rear top edge of the sole-base;

a plurality of holes formed through the front and rear snap plates;

a plurality of sole-base holes in the front snap-fit receptor cavity and the rear snap-fit cavity, the plurality of sole-base holes aligning with the plurality of holes formed through the front and rear snap plates when the front and rear snap plates are disposed in the front and rear snap-fit receptor cavities;

a non-removable sandal-type shoe upper attached to the sole-base;

a front removable shoe upper securable to the non-removable sandal-type shoe upper and to the front snap plate; and a rear removable shoe upper securable to the non-removable sandal-type shoe upper and to the rear snap plate.

10. The convertible shoe of claim 9, wherein:

the front and rear removable shoe uppers are securable to the non-removable sandal-type shoe upper with a hook and loop fastener; and the front and rear removable shoe uppers include a snap fit connector adapted to fit into the plurality of holes in the front and rear snap plates.

* * * * *